US008035967B2

(12) United States Patent
Oh

(10) Patent No.: US 8,035,967 B2
(45) Date of Patent: Oct. 11, 2011

(54) COOLING FAN ASSEMBLY

(75) Inventor: Pil-yong Oh, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 804 days.

(21) Appl. No.: 11/541,741

(22) Filed: Oct. 3, 2006

(65) Prior Publication Data

US 2007/0081891 A1 Apr. 12, 2007

(30) Foreign Application Priority Data

Oct. 7, 2005 (KR) ..... 10-2005-0094551

(51) Int. Cl.
*H05K 7/20* (2006.01)
*F04D 29/44* (2006.01)

(52) U.S. Cl. ..... 361/695; 361/694; 415/208.1

(58) Field of Classification Search ..... 415/208.1, 415/211.2, 220; 361/695
See application file for complete search history.

(56) References Cited

U.S. PATENT DOCUMENTS 5,096,373 A * 3/1992 Struve et al. ..... 415/60
5,246,339 A * 9/1993 Bengtsson et al. ..... 415/208.1
6,045,327 A * 4/2000 Amr ..... 415/211.2
6,533,559 B2 * 3/2003 Hsieh ..... 417/423.5
6,547,540 B1 * 4/2003 Horng et al. ..... 417/423.14
6,609,887 B2 * 8/2003 Moreau et al. ..... 415/211.2
6,652,230 B1 * 11/2003 Huang et al. ..... 415/198.1
6,939,105 B2 * 9/2005 Horng et al. ..... 415/191
6,997,678 B2 * 2/2006 Sun ..... 415/211.2
7,014,420 B2 * 3/2006 Chang ..... 415/121.2
7,052,236 B2 * 5/2006 Chang et al. ..... 415/191
7,094,028 B2 * 8/2006 Chang et al. ..... 415/211.2
7,118,332 B2 * 10/2006 Horng et al. ..... 415/208.2
7,190,578 B2 * 3/2007 Bang et al. ..... 361/694
7,234,914 B2 * 6/2007 Usab et al. ..... 415/1
7,234,919 B2 * 6/2007 Lee et al. ..... 415/208.2
7,275,910 B2 * 10/2007 Chang et al. ..... 415/211.2
7,304,844 B2 * 12/2007 Jan et al. ..... 361/697
7,429,162 B2 * 9/2008 Lee et al. ..... 415/211.2
7,726,939 B2 * 6/2010 Lee et al. ..... 415/211.2
7,731,479 B2 * 6/2010 Chang et al. ..... 415/191
2002/0094271 A1 * 7/2002 Yeuan et al. ..... 415/208.2
2002/0159883 A1 * 10/2002 Simon et al. ..... 415/193
2003/0007867 A1 * 1/2003 Chang ..... 415/220
2005/0186070 A1 * 8/2005 Zeng et al. ..... 415/211.2
2007/0147992 A1 * 6/2007 Yu et al. ..... 415/191
2007/0286717 A1 * 12/2007 Tseng et al. ..... 415/183
2008/0107524 A1 * 5/2008 Chang et al. ..... 415/220
2009/0257869 A1 * 10/2009 Li ..... 415/220

FOREIGN PATENT DOCUMENTS

CN 2644330 Y 4/2003

(Continued)

OTHER PUBLICATIONS

Office Action issued Apr. 4, 2008, from Chinese Patent Office.

*Primary Examiner* — Boris Chervinsky
(74) *Attorney, Agent, or Firm* — Stanzione & Kim, LLP

(57) ABSTRACT

A cooling fan assembly includes a cooling fan unit having a rotating shaft and a plurality of rotating vanes combined with the rotating shaft, and a flow control unit provided in a front of a ventilation direction of the cooling fan unit to control a flow of air to reproduce a rotational directional flow component and to reduce a resistance of the flow of the air in a central portion thereof.

22 Claims, 7 Drawing Sheets

FOREIGN PATENT DOCUMENTS

| | | |
|---|---|---|
| JP | 04-086321 | 3/1992 |
| JP | 05-280494 | 10/1993 |
| JP | 06-264897 | 9/1994 |
| JP | 09-274424 | 10/1997 |
| JP | 11-243667 | 9/1999 |
| KR | 10-0514453 | 9/2005 |

* cited by examiner

COOLING FAN ASSEMBLY

CROSS-REFERENCE TO RELATED APPLICATIONS

This application claims priority from Korean Patent Application No. 2005-0094551, filed on Oct. 7, 2005, in the Korean Intellectual Property Office, the disclosure of which is incorporated herein in its entirety by reference.

BACKGROUND OF THE INVENTION

1. Field of the Invention

The present general inventive concept relates to a cooling fan assembly, and more particularly, to a cooling fan assembly to reduce a flow resistance and to maximize ventilation efficiency by converting a rotational directional flow component generated by rotation of vanes into an axial directional flow component.

2. Description of the Related Art

In general, axial fans used in machinery, electronic products, etc., are widely used for cooling various kinds of heating elements, and are comprised of a rotating shaft, rotating vanes engaged and combined with the rotating shaft, and a driving unit for providing a torque to the rotating shaft. An example of a conventional axial fan structure is disclosed in Korean Patent publication No. 10-2004-0095368 published on Nov. 15, 2004.

However, such a conventional technology has a problem in that though an air flow comprising an axial direction flow component and a rotational direction flow component is created by rotation of rotating vanes and the axial directional flow component performs an effective cooling function, the rotational directional flow component will be vanished to cause a loss, thereby reducing ventilation efficiency to some extent. Furthermore, as illustrated in FIG. 5, there is a problem that a discharged central portion is formed with an abrupt stage and the air flow cannot be facilitated, thereby increasing a resistance according to the air flow in the discharged central portion.

SUMMARY OF THE INVENTION

The present general inventive concept provides a cooling fan assembly to reproduce a rotational directional flow component and to reduce a resistance of an air flow in a central portion thereof.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing an cooling fan assembly, comprising an cooling fan unit having a rotating shaft and a plurality of rotating vanes combined with the rotating shaft, and a flow control unit provided in a front of a ventilation direction of the cooling fan unit to control a flow of air.

The flow control unit may include a plurality of stationary vanes to control a rotational directional flow component of the air discharged from the rotating vanes.

The flow control unit may include a resistance reducing member to protrude toward a discharge direction of the air discharged from the cooling fan unit.

The cooling fan unit may include a driving unit to provide a torque to the rotating shaft, and a fan housing to support the driving unit and to form a shelter for the cooling fan assembly, and the cooling fan assembly may further include a combining unit to combine the flow control unit with the fan housing.

The resistance reducing member may protrude in a streamlined shape.

The combining unit may be a double-sided adhesive tape.

The stationary vane may be formed in a curved shape by gradually increasing a predetermined angle between a tangent line of the stationary vanes and a traverse direction of an axial direction of the rotating shaft to guide the rotational directional flow component of the air discharged from the rotating vanes.

The foregoing and/or other aspects of the present general inventive concept may also be achieved by providing a flow control unit usable in a cooling fan assembly having a cooling fan unit, the flow control unit including a resistance reducing member attached to a housing of the cooling fan unit, and a plurality of stationary vanes extended from the resistance reducing member to control air received from an axial direction of the cooling fan unit to convert a rotational directional flow component of the air into an axial directional flow component of the air.

The foregoing and/or other aspects of the present general inventive concept may also be achieved by providing a cooling fan assembly usable with an electronic apparatus, the cooling fan assembly including a cooling fan unit having a rotating shaft, a plurality of rotating vanes combined with the rotating shaft, and a housing to accommodate the rotating vanes, and controlling air to flow in an axial direction, and a flow control unit having a resistance reducing member attached to the housing of the cooling fan unit, and a plurality of stationary vanes extended from the resistance reducing member to control air received from the axial direction of the cooling fan unit to convert a rotational directional flow component of the air into an axial directional flow component of the air.

The foregoing and/or other aspects of the present general inventive concept may also be achieved by providing an electronic apparatus, including a heat generating unit to generate a heat, and a cooling fan assembly disposed adjacent to the heat generating unit, the cooling fan assembly including a cooling fan unit having a rotating shaft, a plurality of rotating vanes combined with the rotating shaft, and a housing to accommodate the rotating vanes, and controlling air to flow in an axial direction, and a flow control unit having a resistance reducing member attached to the housing of the cooling fan unit, and a plurality of stationary vanes extended from the resistance reducing member to control air received from the axial direction of the cooling fan unit to convert a rotational directional flow component of the air into an axial directional flow component of the air.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
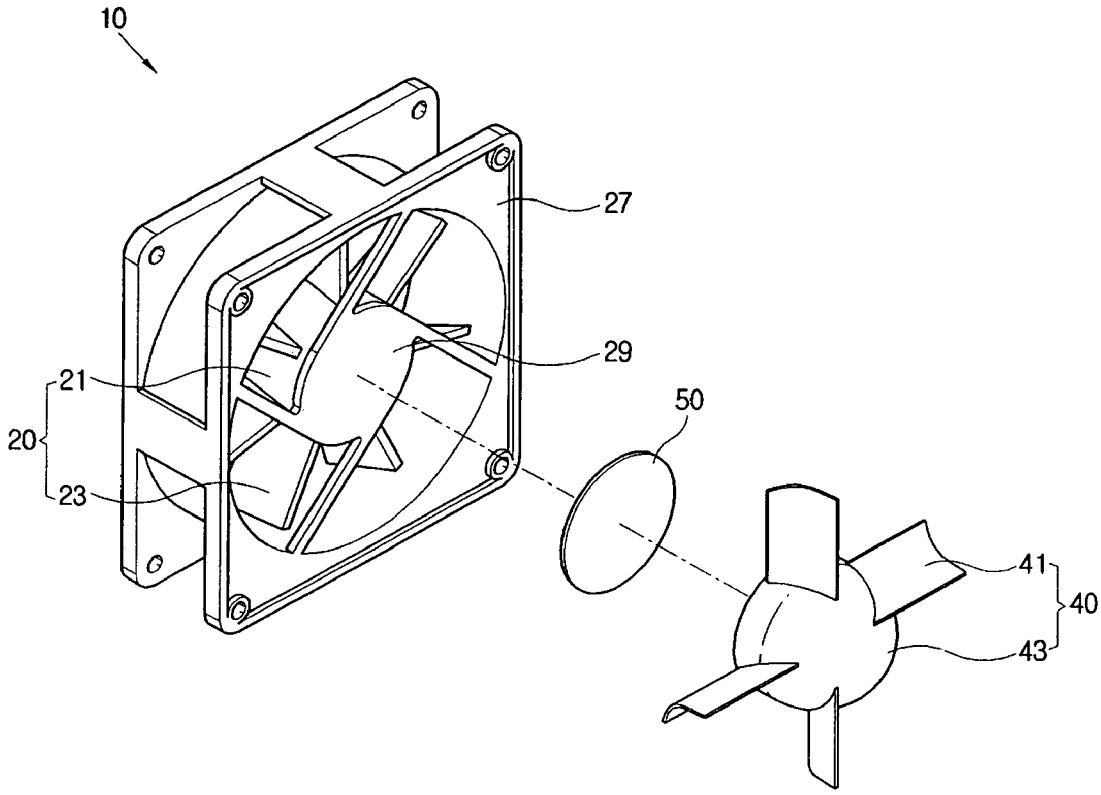
FIG. 1 is an exploded perspective view illustrating a cooling fan assembly usable with an electronic apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the drawings.

Hereinafter, a cooling fan assembly usable with an electronic apparatus according to an embodiment of the present general inventive concept will be described in detail with reference to the accompanying drawings.

Figure 2:
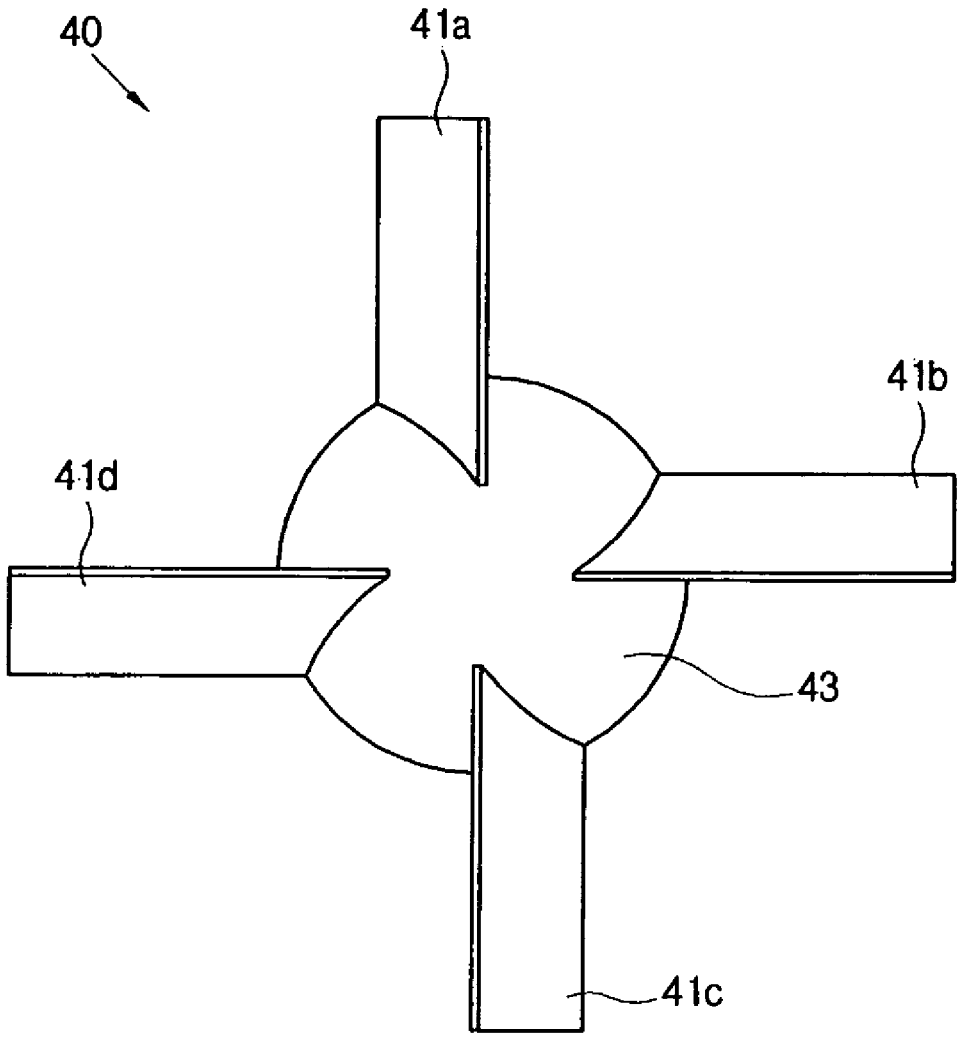
FIG. 2 is a right side view illustrating a flow control unit of the cooling fan assembly of FIG. 1.

FIG. 1 is an exploded perspective view illustrating a cooling fan assembly 10 usable with an electronic apparatus according to an embodiment of the present general inventive concept. FIG. 2 is a side view illustrating a flow control unit 40 of the cooling fan assembly of FIG. 1. Referring to FIGS. 1 and 2, the cooling fan assembly 10 comprises a cooling fan unit 20 having a rotating shaft 21, a plurality of rotating vanes (rotating fans) 23 combined with the rotating shaft 21 to ventilate air in an axial direction thereof, and a driving unit 25 (FIG. 4) to provide a torque to the rotating shaft 21, and the flow control unit 40 provided in a front of a ventilation direction of the cooling fan unit 20 and having at least one of stationary vanes 41 (41*a*, 41*b*, 41*c*, and 41*d* of FIG. 2) and a resistance reducing member 43 to control a flow of the air. The cooling fan assembly 10 further comprises a fan housing 27 and a combining unit 50 to combine or couple the flow control unit 40 with the fan housing 27.

The plurality of rotating vanes 23 are engaged with the rotating shaft 21 or fixedly attached to the rotating shaft 21, and the driving unit 25 controls the rotating shaft 21 and the rotating vanes 23 to rotate. The cooling fan unit 20 includes a fan housing 27 to form a shelter for the cooling fan assembly 10 and to support the driving unit 25. The cooling fan unit 20 is combined with the flow control unit 40 to form the cooling fan assembly 10.

Figure 5:
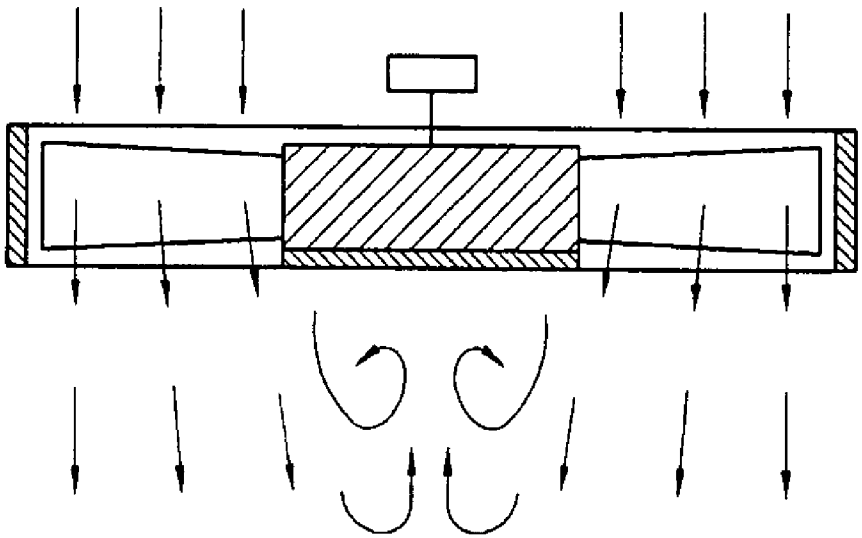
FIG. 5 is a side sectional view illustrating an air flow in a conventional fan unit.

The rotating shaft 21 delivers a driving force provided by the driving unit 25 to the rotating vanes 23. The rotating shaft 21 may not form a passage of the air, and the flow control unit 40 which will be described later is provided in close proximity to an end of the rotating shaft 21 in a direction of which the air is discharged. The flow control unit 40 may be disposed on a position where a central portion of a discharged air is formed with an abrupt stage in a conventional fan structure as illustrated in FIG. 5.

Figure 3A:
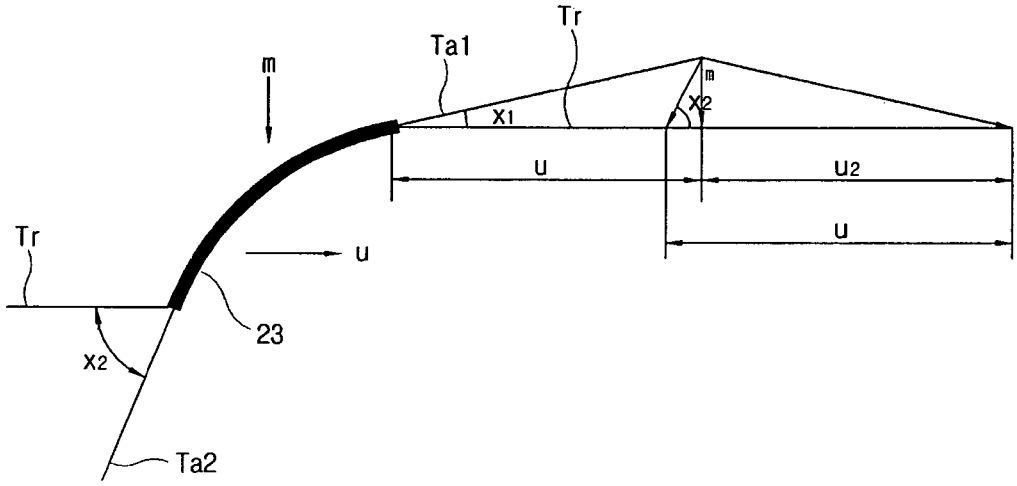
FIG. 3A is a view illustrating a velocity triangle of a flow rate component of air in rotating vanes of the cooling fan assembly of FIG. 1.

The rotating vanes 23 is combined with the rotating shaft 21 to deliver the torque provided by the driving unit 25, and engaged with the rotating shaft 21 to ventilate the air in the axial direction. Referring to FIG. 3A, the rotating vanes 23 have an axial directional flow component (m) and a rotational directional flow component (u) generated by rotation of the rotating vanes 23. Here, the axial directional flow component (m) is actually used to cool or transfer heat generated in the electronic apparatus, but the rotational directional flow component (u) is vanished to cause a loss of ventilation power thereof, and reduces a ventilation efficiency of the cooling fan unit 20. Such velocity components (m, u) are shown below with reference to FIG. 3A, In other words, the axial directional flow component (m) is identical at an inflow side or a discharge side in a vane-based coordinate. However, in the vane-based coordinate, the rotational directional flow component (u) is u at the inflow side, but at the discharge side, the rotational directional flow component (u) is changed by an amount of:

$$\frac{m}{\tan(x2)} \tag{1}$$

Furthermore, if the inflow side flow component is converted into the discharge side flow component in a global coordinate, then the axial directional flow component is m, but a second rotational directional flow component (u2) is:

$$u2 = -\frac{m}{\tan(x2)} + u = u\left(1 - \frac{1}{\tan(x2)}\right) \tag{2}$$

Here, an angle x1 is an angle between a tangent line Ta1 of an inflow side of the rotating vanes 23 and a traverse direction line Tr of the axial direction thereof, and an angle x2 is an angle between a tangent line Ta2 of an exit side of the rotating vanes 23 and the traverse direction line Tr of the axial direction thereof.

Thus, the second rotational directional flow component (U2) is vanished to cause the loss. According to the present embodiment, the stationary vanes 41 of the flow control unit 40 which will be described later are provided to prevent such a loss.

Figure 4:
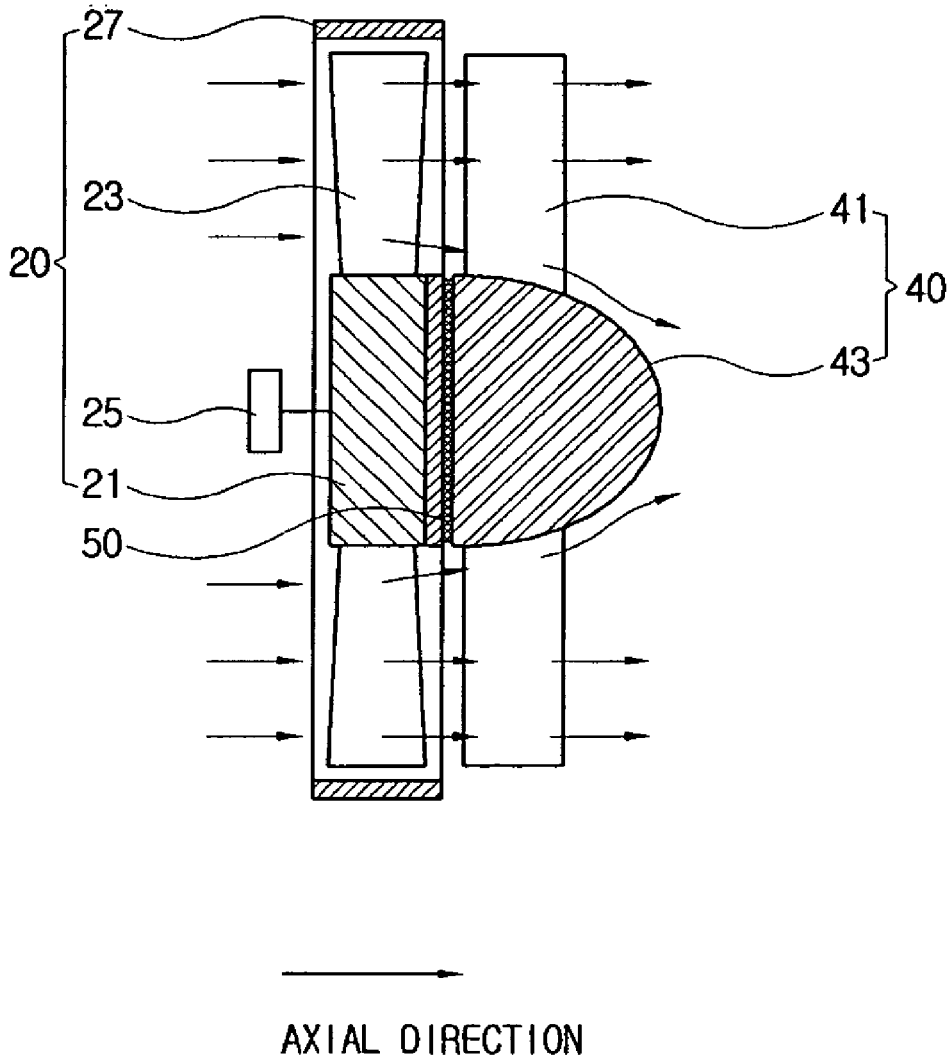
FIG. 4 is a side sectional view illustrating a flow of air of the cooling fan assembly of FIGS. 1 and 2.

As illustrated in FIG. 4, the driving unit 25 provides the torque to the rotating shaft 21 by applying a power source. The driving unit 25 can be disposed in a same axial line as the rotating shaft 21 not to obstruct a ventilating passage. The driving unit 25 can be a conventional driving unit such as a motor or the like.

The fan housing 27 supports the driving unit 25 and forms a shelter for the cooling fan assembly 10. The flow control unit 40 is combined with the fan housing 27 by the combining unit 50. The fan housing 27 has a combining element 29 provided in a central region in a direction of which the air is discharged to face the rotating shaft 21 and to combine with the flow control unit 40. A combination of the fan housing 27 and the flow control unit 40 can be made in a central portion of the fan housing 27. It is also possible that the combination of the fan housing 27 and the flow control unit 40 can be made in an edge portion of the fan housing 27. That is, the combining element 29 can be disposed on an outer circumferential rim of the fan housing 27 such that the flow control unit 40 is attached to the outer circumferential rim of the fan housing 27 using the combining unit 50. According to the present embodiment, the flow control unit 40 is combined with the combining element 29 of the fan housing 27 to reduce the resistance generated in the central region of the ventilation direction, and guide the flow of the air by the stationary vanes 41.

The flow control unit 40 is provided in the front of the ventilation direction of the cooling fan unit 20 to control the flow of the air. Furthermore, the plurality of stationary vanes 41 of the flow control unit 40 controls the second rotational directional flow component (u2) of the air discharged from the rotating vanes 23 to guide the flow of the air. Moreover, the resistance reducing member 43 of the flow control unit 40 protrudes toward the discharge direction of the air discharged from the cooling fan unit 20. Furthermore, the flow control unit 40 is combined with the fan housing 27 to reduce the resistance generated in the central region and to guide the flow of the air by the stationary vanes 41. Since the flow control unit 40 is used in the same environment as the cooling fan unit 20, the flow control unit 40 is formed with the same material as the cooling fan unit 20, but the present general inventive concept is not limited thereto. The material can be changed if necessary.

Figure 3B:
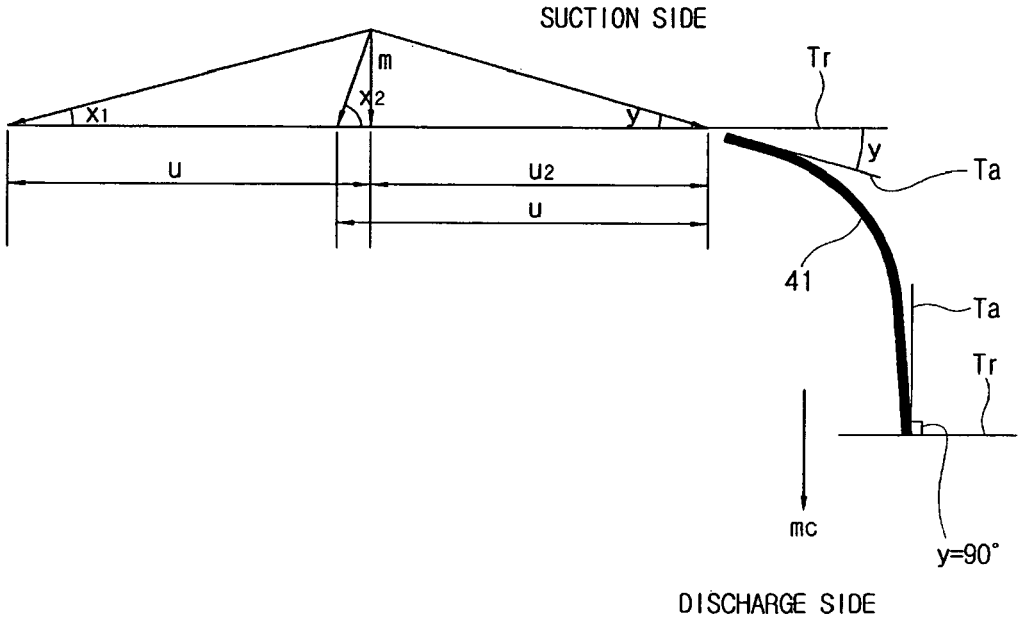
FIG. 3B is a view illustrating a velocity triangle of a flow rate component of air in the flow control unit of FIG. 2.

The stationary vanes 41 are provided in plural to control the second rotational directional flow component (u2) of the air discharged from the rotating vanes 23, facing to the ventilation passage of the cooling fan unit 20. Referring to FIG. 3B, the stationary vanes 41 are formed in a curved shape to guide the second rotational directional flow component (u2) discharged from the rotating vanes 23. As a result, the second rotational directional flow component (u2) discharged from the rotating vanes 23 is guided by the shape of stationary vanes 41 and vanished at an exit side while passing through the stationary vanes 41. In other words, the stationary vanes 41 are formed with a structure in which an angle (y) between a tangent line Ta and a traverse direction line Tr of the axial direction in the stationary vanes 41 gradually increases as it advances from an inflow side (suction side) to a discharge side (exit side) of the stationary vanes 41. It is shown below with reference to FIG. 3B. First, in the vane-based coordinate, the axial directional flow component (m) is:

$$m=u*\tan(x1) \tag{3}$$

As described above, the loss of the rotational directional flow component (u2) in the global coordinate is:

$$u2 = -\frac{m}{\tan(x2)} + u = u\left(1 - \frac{1}{\tan(x2)}\right) \tag{2}$$

In a velocity triangle of FIG. 3B, $$\tan(y) = \frac{m}{u2} = \frac{\tan(x1)}{\left(1 - \frac{1}{\tan(x2)}\right)} \tag{4}$$

Here, when equation (4) is arranged for the angle y, the angle y between the tangent line Ta and the traverse direction line Tr of the axial direction in the stationary vanes 41 is:

$$y = \operatorname{atan}\frac{\tan(x1)}{\left(1 - \frac{1}{\tan(x2)}\right)} \tag{5}$$

Therefore, the y value can be calculated in a suction side (inflow side) of stationary vanes 41 by equation (5), and the shape of stationary vanes 41 can be made in a manner that a value of the angle y at the discharge side (exit side) where the air is finally discharged from the stationary vanes 41 will be 90 degrees. As a result, the second rotational directional flow component (u2) passing through the curved stationary vanes 41 of the flow control unit 40 is reproduced as a predetermined axial directional flow component mc to enhance ventilation efficiency.

Referring back to FIGS. 1 and 2, the resistance reducing member 43 is provided in the same axial line as the rotating shaft 21 with a size corresponding to the rotating shaft 21 in the central portion of the flow control unit 40, and protrudes toward the discharge direction of the air discharged from the cooling fan unit 20. Furthermore, the resistance reducing member 43 may protrude in a streamlined shape to an outside thereof to reduce the resistance more effectively. Moreover, the shape of the resistance reducing member 43 can be changed in a variety of shapes such as a triangular pyramid and an elliptic cone in consideration of a space of installed position of the flow control unit 40 or the cooling fan unit 20 in the electronic apparatus. Accordingly, the resistance reducing member 43 protruding in a ventilating central region is provided to reduce the resistance of the air that flows around the rotating shaft 21.

The combining unit 50 combines the cooling fan unit 20 with the flow control unit 40. Moreover, the combining unit 50 can be used with a variety of conventional members, such as bolt, bond, etc., and double-sided adhesive tapes can be employed as the combining unit 50. The double-sided adhesive tape is useful when the flow control unit 40 is combined with an existing cooling fan unit, and a material including acrylic polymer can be employed as the double-sided adhesive tape, or the material can be changed to a conventional material to maintain a strong adhesive force and having an excellent thermal resistance. Although the present embodiment illustrates the combining unit 50 to combine the combining element 29 of the fan housing 27 disposed in a center portion with the resistance reducing member 43 of the flow control unit 40, it is possible that an edge of the fan housing 27 can be combined with an edge of the flow control unit 40 when the combining element 29 is disposed on the edge of the fan housing 27.

The cooling fan assembly 10 according to the present embodiment can be used to cool not only a display device but also an electronic product, various kinds of industrial machines, etc., and as a matter of course it can be applied to various kinds of ventilations or the like, such as housing, etc.

Figure 6:
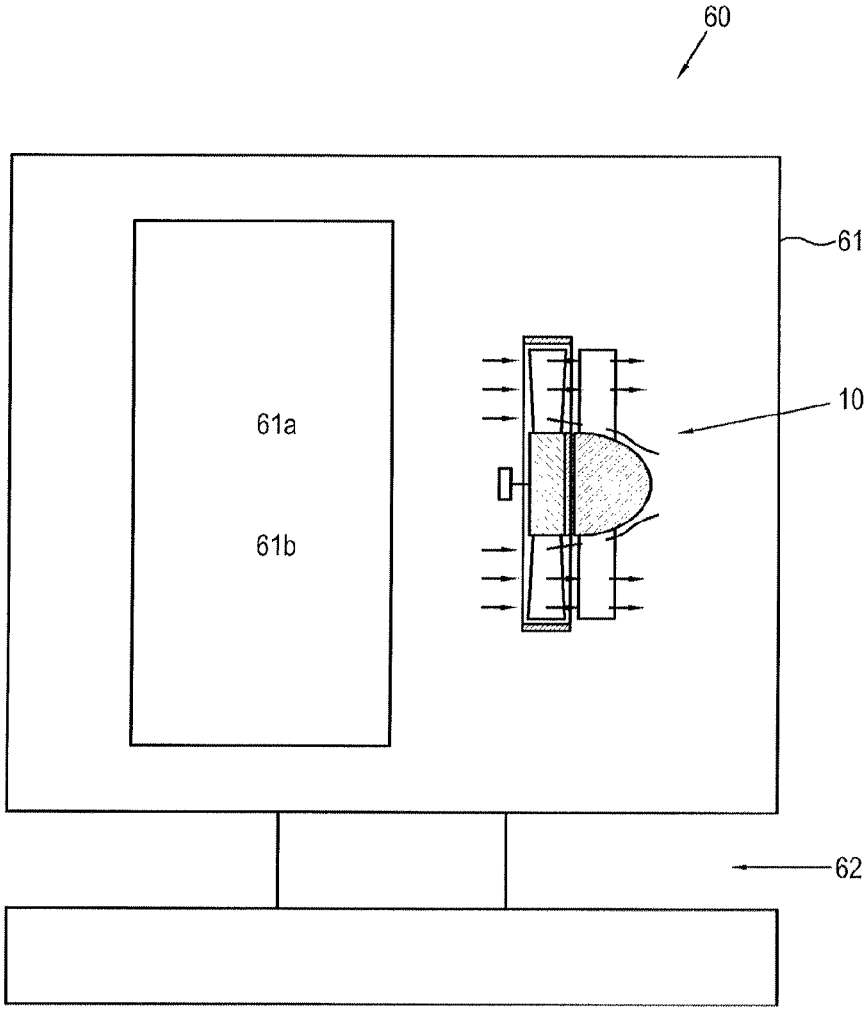
FIG. 6 is a view illustrating a display apparatus having a cooling fan assembly according to an embodiment of the present general inventive concept.

As an example of the present embodiment, FIG. 6 is a view illustrating a display device 60 when the cooling fan assembly 10 is used in the display device 60. The display device 60 comprises a display unit 61 to form an image and a stand 62 to support the display unit 61. The display unit 61 comprises a display panel 61*a* and a circuit board 61*b* to drive the display panel 61*a*. The display unit 61 may further include a heat-generating unit, such as a light source unit, a circuit board, or the like, in the display panel 61*a*. The cooling fan assembly may be installed near the heat-generating unit (display unit 61) to cool heat generated from the heat-generating unit.

FIG. 4 is a side sectional view illustrating a flow of air of the cooling fan assembly 10 of FIGS. 1 and 2. An air flow process of the cooling fan assembly 10 according to an embodiment of the present general inventive concept will be described with reference to FIGS. 3A, 3B, and 4.

First, when a power is applied, the driving unit 25 operates to rotate the rotating shaft 21 by the torque provided by the driving unit 25. When the rotating vanes 23 engaged with the rotating shaft 21 rotate, the cooling fan unit 20 controls the air to flow in a predetermined direction. A velocity component of the flowing air, as illustrated in FIG. 3A, is divided into axial and rotational directional flow components (m, u). Here, the axial directional flow component (m) flows straight in the axial direction, but the rotational directional flow component (u) whirls around and advances in the ventilation direction. The rotational directional flow component (u), as illustrated in FIG. 3B, will be guided along with the shape of the stationary vanes 41 in the flow control unit 40, and the rotational directional flow component u2 will be vanished at an end, which is formed perpendicular to the axial direction and discharged from the stationary vanes 41, whereby it will be changed to an axial directional flow component to be reproduced as an effective component in cooling the electronic apparatus generating heat. Furthermore, for the air ventilating around the rotating shaft 21, the passage of the air is formed along with the resistance reducing member 43 protruding in the streamlined shape while being discharged from the cooling fan unit 20, whereby flow resistance including a vortex or the like is less generated, compared with a case where the discharged end of the rotating shaft 21 is vertical. As a result, a flow resistance flowing around the rotating shaft 21 can be reduced.

Therefore, according to the present embodiment, the rotational directional flow component reducing a cooling efficiency, which is generated from the cooling fan unit, is vanished by the guidance of the auxiliary vanes of the flow control unit, and reproduced as an axial directional flow component, whereby the cooling efficiency according to the ventilation of the cooling fan unit can be improved. Moreover, by forming the resistance reducing member in a streamlined shape in the flow control unit, it is possible to reduce a resistance against the flow of the air flowing around the rotating shaft while ventilating, as well as a resistance noise. Moreover, the flow control unit can be conveniently attached to the cooling fan unit by double-sided adhesive tapes, whereby it can be easily applied to not only a newly produced cooling fan unit but also an existing cooling fan unit.

As described above, according to the present embodiment, an cooling fan assembly is provided in which an efficiency of an cooling fan unit can be improved by reproducing a rotational directional flow component in an axial directional flow component, a flow resistance of the air discharged along with the central part can be reduced, and a flow control unit that is simply applied to an existing cooling fan unit can be provided.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A cooling fan assembly, comprising:

a cooling fan unit having a rotating shaft and a plurality of rotating vanes combined with the rotating shaft; and a flow control unit provided in a front of a ventilation direction of the cooling fan unit to control a flow of air discharged from the cooling fan unit, wherein the flow control unit comprises a resistance reducing member to protrude toward a discharge direction of the air discharged from the cooling fan unit, and a plurality of stationary vanes formed around the resistance reducing member to control a rotational directional flow component of the air discharged from the rotating vanes such that the rotational directional flow component discharged from the rotating vanes is guided by the shape of stationary vanes and the rotational directional flow component passing through the plurality of stationary vanes is reproduced as a predetermined axial direction flow component, wherein the plurality of stationary vanes control the direction of the predetermined axial direction flow component to shift from a direction perpendicular to an axial direction of the rotating shaft to a direction parallel to the axial direction of the rotating shaft as air flows towards the discharge direction, and wherein the resistance reducing member extends beyond the plurality of stationary vanes to guide the rotational directional flow component of the air along a surface of the resistance reducing member.

2. The cooling fan assembly according to claim 1, wherein the stationary vane is formed in a curved shape by gradually increasing an angle between a tangent line of the stationary vanes and a traverse direction of an axial direction of the rotating shaft to guide the rotational directional flow component of the air discharged from the rotating vanes.

3. The cooling fan assembly according to claim 1, wherein the resistance reducing member protrudes in a streamlined shape.

4. The cooling fan assembly according to claim 1, wherein the cooling fan unit comprises a driving unit to provide a torque to the rotating shaft, a fan housing to support the driving unit and to form a shelter thereof, a combining unit to combine the flow control unit with the fan housing.

5. The cooling fan assembly according to claim 4, wherein the combining unit comprises a double-sided adhesive tape.

6. A flow control unit usable in a cooling fan assembly having a cooling fan unit with a rotating shaft and a plurality of rotating vanes combined with the rotating shaft, comprising:

a resistance reducing member attached to a housing of the cooling fan unit; and a plurality of stationary vanes extending from and around the resistance reducing member to control air discharged from the plurality of rotating vanes and received from an axial direction of the cooling fan unit and to convert a rotational directional flow component of the air discharged from the plurality of rotating vanes and passing through the plurality of stationary vanes into a predetermined axial directional flow component of the air, such that the rotational directional flow component discharged from the rotating vanes is guided by the shape of the stationary vanes, wherein the plurality stationary vanes control the predetermined axial directional flow component to shift from a direction perpendicular to an axial direction of the rotating shaft to a direction parallel to the axial direction of the rotating shaft as air flows towards a discharge direction, and wherein the resistance reducing member extends beyond the plurality of stationary vanes to guide the rotational directional flow component of the air along a surface of the resistance reducing member.

7. The flow control unit according to claim 6, wherein the resistance reducing member is attached to one of a center portion and an edge portion of the housing.

8. The flow control unit according to claim 6, wherein the plurality of rotating vanes extends from the rotating shaft, and the resistance reducing member is coupled to the rotating shaft and extends in a first direction that is perpendicular to the axial direction, and the plurality of stationary vanes are disposed downstream from the plurality of the rotating vanes, the plurality of stationary vanes extending from the resistance reducing member in the first direction.

9. The flow control unit according to claim 6, wherein the stationary vanes are in a stationary state with respect to the housing of the cooling fan unit.

10. The flow control unit according to claim 6, wherein the stationary vanes receive the air from the cooling fan unit in the axial direction and discharge the received air in the axial direction.

11. The flow control unit according to claim 6, wherein the stationary vanes have an angle between a tangent line thereof and a traverse direction perpendicular to the axial direction, and the angle increases from an inflow side to a discharge side of the stationary vanes.

12. The flow control unit according to claim 11, wherein the stationary vanes comprises a stationary distal end having the angle of 90 degrees in relation to the traverse direction perpendicular to the axial direction at the discharge side.

13. The flow control unit according to claim 11, wherein the stationary vanes comprises a stationary distal end parallel to the axial direction at the discharge side.

14. The flow control unit according to claim 11, wherein the cooling fan unit comprises the plurality of rotating vanes having a rotating distal end having a rotating angle at an exit side of the cooling fan unit facing the flow control unit, and the angle of the stationary vanes comprises a first angle equal to or greater than the rotating angle and a second angle of about 90 degrees in relation to the traverse direction perpendicular to the axial direction.

15. The flow control unit according to claim 6, wherein the resistance reducing member comprises a shape having a cross-sectional area varying in the axial direction.

16. The flow control unit according to claim 6, wherein the resistance reducing member is disposed in a center portion of the cooling fan unit where the air from the cooling fan unit has an abrupt state.

17. A cooling fan assembly usable with an electronic apparatus, comprising:

a cooling fan unit having a rotating shaft, a plurality of rotating vanes combined with the rotating shaft, and a housing to accommodate the rotating vanes, and controlling air to flow in an axial direction; and a flow control unit having a resistance reducing member attached to the housing of the cooling fan unit, and a plurality of stationary vanes extending from and around the resistance reducing member to control air discharged from the plurality of rotating vanes and received from the axial direction of the cooling fan unit and to convert a rotational directional flow component of the air discharged from the plurality of rotating vanes and passing through the plurality of stationary vanes into a predetermined axial directional flow component of the air, such that the rotational directional flow component discharged from the rotating vanes is guided by the shape of the stationary vanes, wherein the plurality of stationary vanes control the predetermined axial directional flow component to shift from a direction perpendicular to an axial direction of the rotating shaft to a direction parallel to the axial direction of the rotating shaft as air flows towards a discharge direction, and wherein the resistance reducing member extends beyond the plurality of stationary vanes to guide the parallel axial direction of air flow along a surface of the resistance reducing member.

18. An electronic apparatus, comprising:

a heat generating unit to generate a heat; and a cooling fan assembly disposed adjacent to the heat generating unit, the cooling fan assembly comprising:

a cooling fan unit having a rotating shaft, a plurality of rotating vanes combined with the rotating shaft, and a housing to accommodate the rotating vanes, and controlling air to flow in an axial direction; and a flow control unit having a resistance reducing member attached to the housing of the cooling fan unit, and a plurality of stationary vanes extending from and around the resistance reducing member to control air discharged from the plurality of rotating vanes and received from the axial direction of the cooling fan unit and to convert a rotational directional flow component of the air discharged from the plurality of rotating vanes and passing through the plurality of stationary vanes into a predetermined axial directional flow component of the air, such that the rotational directional flow component discharged from the rotating vanes is guided by the shape of the stationary vanes, wherein the plurality of stationary vanes control the predetermined axial directional flow component to shift from a direction perpendicular to an axial direction of the rotating shaft to a direction parallel to the axial direction of the rotating shaft as air flows towards a discharge direction, wherein the resistance reducing member extends beyond the plurality of stationary vanes to guide the parallel axial direction of air flow along a surface of the resistance reducing member.

19. The electronic apparatus according to claim 18, wherein the heat generating unit comprises a circuit board to generate heat.

20. The electronic apparatus according to claim 18, wherein the heat generating unit comprises a display panel on which an image is displayed.

21. The electronic apparatus according to claim 18, wherein the electronic apparatus comprises a display device having the heat generating unit and the cooling fan assembly.

22. The electronic apparatus according to claim 18, wherein the heat generating unit comprises a display panel having a major surface in a direction perpendicular to the axial direction, and the cooling fan assembly is disposed parallel to the display panel.

* * * * *